United States Patent [19]

Grant et al.

[11] 4,270,802

[45] Jun. 2, 1981

[54] PERMEABILITY RESTORATION AND LOWERING OF URANIUM LEAKAGE FROM LEACHED ORE BEDS

[75] Inventors: David C. Grant, Pittsburgh; Herbert A. Burgman, Murrysville, both of Pa.

[73] Assignee: The United States of America as represented bythe Secretary of the Interior, Washington, D.C.

[21] Appl. No.: 109,361

[22] Filed: Jan. 3, 1980

[51] Int. Cl.[3] ..... E21B 43/28

[52] U.S. Cl. ..... 299/5; 423/15

[58] Field of Search ..... 299/4, 5; 423/15

[56] References Cited

U.S. PATENT DOCUMENTS 4,155,982 5/1979 Hunkin et al. ..... 423/15 X

*Primary Examiner*—Ernest R. Purser

*Attorney, Agent, or Firm*—William S. Brown; Donald A. Gardiner

[57] ABSTRACT

The injection of an ammonium sulfite or bisulfite solution increases the permeability of an uranium ore bed that has suffered permeability losses during the in-situ mining of uranium with an alkaline leach solution containing a peroxide or dissolved oxygen oxidant. Such an injection recovers much of the lost formation permeability, thus decreasing costs and effort required to put needed restoration solutions or further leach solutions through the ore bed. In addition, uranium contamination of the ground water normally occurring after cessation of leaching is significantly lowered by such injection.

6 Claims, No Drawings

PERMEABILITY RESTORATION AND LOWERING OF URANIUM LEAKAGE FROM LEACHED ORE BEDS

DESCRIPTION

1. Technical Field

This invention relates to the in-situ or solution mining of uranium and, more particularly, to the restoration of permeability of subterranean formations containing uranium mineral deposits in which mining is no longer practical because of reduced formation permeability.

2. Background Art

Conventional in-situ uranium mining is carried out by drilling an array of wells into the subterranean uranium ore deposit from the surface of the ground and injecting into the deposit, through one or more of these wells, an alkaline carbonate or bicarbonate leach solution containing an oxidant. The oxidant converts the insoluble, tetravalent uranium values to the hexavalent state, in which form they are readily solubilized in the leach solution. The leach solution containing uranium values in solution is then pumped to the surface through one or more of the same wells and uranium is recovered therefrom in any convenient manner well known in the art. For a general description of the above process, reference can be made to Menke U.S. Pat. No. 2,896,930.

Typically, the oxidant contained in the leach solution is hydrogen peroxide or a dissolved oxygen bearing gas such as air or commercial oxygen. These oxidants are disclosed collectively in Rhoades U.S. Pat. No. 3,792,903 and individually in prior art disclosures such as the above noted Menke patent and Hard et al. U.S. Pat. No. 3,708,206, among others. An inherent problem encountered in the in-situ mining of uranium ore deposits with alkaline leach solutions is that the oxygen furnished by the oxidant ultimately bubbles out of the solution while in the subterranean formation, thus causing gas blockage in the ore bed and a consequent decrease in permeability. See, for example, Learmont U.S. Pat. No. 3,860,289. Another problem created by the in-situ mining of uranium with leach solutions containing an oxidant is that post-leach contamination of the ground water by hexavalent uranium is considerable. This problem appears never to have been previously dealt with and the environmental consequences of in-situ uranium mining have been generally disregarded.

DISCLOSURE OF INVENTION

It is, therefore, an object of this invention to provide a process for restoring the permeability of uranium ore beds which have suffered permeability losses during the in-situ mining of uranium with alkaline leach solutions containing an oxidant.

It is another object of this invention to provide a process for lowering the uranium contamination of ground water that occurs as a consequence of the in-situ mining of uranium ore beds.

Other objects and advantages will become apparent from the following description and the appended claims.

Briefly stated, the objects of this invention are obtained by a process which comprises, as its essential step, injecting into the leached ore formation an aqueous ammonium sulfite or bisulfite solution. Following this injection the solution may be pumped or otherwise removed from the formation and leaching of the uranium ore with alkaline leach solution resumed to recover additional uranium values from the formation. The overall pumping costs of operating an in-situ uranium mine are reduced by leaching the ore bed until permeability drops to an unacceptable level, then improving the permeability by injection of ammonium sulfite or bisulfite, releaching the ore bed with alkaline leach solution, and repeating this sequence of steps until the further mining of the deposit becomes uneconomical or no longer feasible.

Ammonium sulfite and bisulfite injection solutions function to react with the free oxygen in the leached ore formation thereby breaking up the gas bubbles which block the passage of leach solution. Coincidentally, such solutions reduce residual uranium values in solution to an insoluble condition, thereby lowering the leakage of solubilized uranium from the ore bed.

BEST MODE FOR CARRYING OUT INVENTION

During in-situ uranium mining with an ammonium bicarbonate leach solution containing a peroxide or dissolved oxygen oxidant, the permeability of the ore deposit declines steadily until it stabilizes at a relatively low level. The energy and, consequently, the cost required for the injection and recovery of such solutions from the ore body increases as the permeability drops.

It is believed that the decline in formation permeability is brought about by the oxidant content of the leach solution bubbling out of solution while in the formation causing gas blockage in the ore bed. The bubbling may be the result of the peroxide oxidant breaking down during the oxidation of the tetravalent uranium values contained in the deposit or, simply, the deaeration of dissolved oxygen leach solution feed due to the pressure drop that occurs as the solution passes through the ore body. Since they are reducing agents, ammonium sulfite and bisulfite solutions are thought to react with and thus redissolve the oxygen that has come out of solution during the leaching operation. Accordingly, any oxygen gas build-up in the formation is removed or at least minimized by the ammonium sulfite or bisulfite injection with a resultant increase in formation permeability.

The concentration of the ammonium sulfite or bisulfite in the injection solution can vary widely but, in general, will be dependent upon the oxidant content of the leach solution. In the usual situations, where the leach solution contains a moderate to large excess of oxidant, ammonium sulfite or bisulfite concentrations ranging from 0.5 to 2 g/l have been found to increase the permeability of the formation by a factor of about 5 to 10 within a one day period. Lower concentrations would also be operable albeit slower and less efficient. Such lower concentrations are not recommended, it being kept in mind that chemical costs decrease as the concentration of the solution is decreased but that the pumping expenses required to obtain the same level of benefit are increased.

When the injection solution of this invention is being contemplated primarily for the purpose of lowering uranium leakage from the ore deposit, the ammonium sulfite or bisulfite solution should be injected into the formation for up to four or five days, and preferably for about four to five days. This may be the circumstance, for example, when the uranium content of the leach solution recovered from the formation is so low that continued mining at the site is not economically feasible and environmental clean-up is the impetus for practicing the present process. Following the sulfite or bisulfite injection, additional solutions well known in the art may be injected into the bed if it is desired to remove the ammonium ions from the deposit.

Ammonium sulfite and bisulfite have an advantage over other reducing agents, such as sodium sulfite or sodium bisulfite, in the practice of this invention. The latter agents exchange sodium ions with the ammonium on the ore, and sodium substituted ores have consistently shown poorer permeabilities than ammonium substituted ores. Thus, if solutions containing sodium are employed for restoration, the pumping costs during subsequent leaching of the ore bed would likely be more than if the ore had remained unrestored.

Tests have been performed using an ammonium bisulfite solution having a concentration of 2.0 g/l. Prior to injection of the ammonium bisulfite solution, the ore bed had been undergoing leaching operations to recover uranium employing a leach solution consisting essentially of 1.0 g/l ammonium bicarbonate and 0.5 g/l hydrogen peroxide and its permeability had stabilized at a relatively low level. The results of the test, by tracing the permeability of the mine starting at the forty-second day of operation, are shown in the table below.

| Test Duration days | Injection Materials | Permeability darcys |
|---|---|---|
| 42 | 1.0 g/l $NH_4HCO_3$ + 0.5 g/l $H_2O_2$ | 0.085 |
| 43.5 | " | 0.060 |
| 45.5 | " | 0.050 |
| 47 | " | 0.050 |
| 48.5 | " | 0.035 |
| 51 | " | 0.055 |
| 53 | " | 0.050 |
| 54 | 2.0 g/l $NH_4HSO_3$ | |
| 55.5 | " | 0.465 |
| 57 | " | 0.510 |
| 58.5 | " | 0.525 |
| 60 | " | 0.500 |
| 61.5 | " | 0.470 |

It is noteworthy that the ammonium bisulfite injection treatment markedly increased the permeability of the ore bed by a factor of about 10. In addition, the ammonium bisulfite injection has the added environmental benefit of reducing the dissolved hexavalent uranium values in the formation to the insoluble tetravalent state. Tests demonstrate that the post-leach contamination of the ground water in the ore field by uranium solubilized during leaching operations normally ranges from about 10 to 20 mg/l. Presently, environmental regulations require that the uranium content of the ground water be about 2 mg/l. It has now been shown that the injection of ammonium bisulfite into the formation for from four to five days after cessation of alkaline leaching lowers ground water uranium contamination to less than 2 mg/l.

INDUSTRIAL APPLICABILITY

The practice of this invention permits subterranean uranium deposits which have become uneconomical to mine because of low permeability to once again become practical sources of uranium recoverable by solution mining techniques. Thus, after a formation's permeability has been improved by the injection of ammonium sulfite or bisulfite in accordance with this invention, the uranium ore can be mined by a conventional alkaline carbonate or bicarbonate leach solution containing an oxidant until the permeability of the formation again becomes too low for economical mining. At this point the formation may again be treated with an ammonium sulfite or bisulfite injection solution to improve permeability. This sequence of steps may be repeated several times until permeability cannot be restored to a level economical for continued mining or until the formation is not practical for mining because of other reasons.

What is claimed is:

1. In a process for the in-situ mining of uranium comprising the steps of injecting an alkaline leach solution containing an oxidant into a subterranean uranium ore bed, pumping to the surface leach solution containing uranium values in solution, and continuing said injecting and pumping operations until mining is no longer practical because of the reduced permeability of said ore bed, the improvement comprising the steps of injecting into the leached ore bed an aqueous ammonium sulfite or bisulfite solution to improve the permeability of said bed, and thereafter injecting alkaline leach solution containing an oxidant into said ore bed to recover additional uranium values from said ore bed.

2. A process in accordance with claim 1, wherein said aqueous solution contains up to 2 g/l ammonium sulfite or bisulfite.

3. A process in accordance with claim 1, wherein said aqueous solution comprises about 2 g/l ammonium bisulfite.

4. A process in accordance with claim 1, wherein said aqueous solution is injected into said leached ore bed for a period of from about one to five days.

5. A process in accordance with claim 4 wherein said injection period is about one day.

6. A process in accordance with claim 4, wherein said injection period is about four to five days.

* * * * *